United States Patent [19]

Bond et al.

[11] 4,255,497

[45] Mar. 10, 1981

[54] FERRITIC STAINLESS STEEL

[75] Inventors: Armand P. Bond, Livonia; Anthony J. Bryhan, Ann Arbor, both of Mich.; James D. Redmond, Pittsburgh, Pa.

[73] Assignee: Amax Inc., Greenwich, Conn.

[21] Appl. No.: 53,149

[22] Filed: Jun. 28, 1979

[51] Int. Cl.[3] ..... C22C 38/06; B32B 15/18

[52] U.S. Cl. ..... 428/685; 75/124; 75/128 N; 75/128 G; 75/128 T; 75/128 W

[58] Field of Search ..... 75/124, 128 N, 128 G, 75/128 T, 128 W; 428/685

[56] References Cited

U.S. PATENT DOCUMENTS

| | | | |
|---|---|---|---|
| 3,957,544 | 5/1976 | Pinnow et al. | 75/128 N |
| 3,992,198 | 11/1976 | Demo, Jr. | 75/126 C |
| 4,119,765 | 10/1978 | Pinnow et al. | 428/683 |
| 4,155,752 | 5/1979 | Oppenheim | 75/128 N |

OTHER PUBLICATIONS

Smechyshen, M. et al., "Effects of Composition on Ductility and Toughness of Ferritic Stainless Steels," *Toward Improved Ductility and Toughness, Kyoto International Conference Hall*, pp. 235–250, Climax Molybdenum Development Co., Tokyo, Japan (1971).

*Primary Examiner*—Michael L. Lewis
*Attorney, Agent, or Firm*—Michael A. Ciomek

[57] ABSTRACT

A ferritic stainless steel having improved impact properties contains between about 21% and about 30% chromium, up to about 5% molybdenum, up to about 6% nickel, between about 0.1% and about 0.4% niobium, between about 0.1% and about 0.75% aluminum, up to about 0.3% titanium, up to about 0.025% carbon, up to about 0.035% nitrogen, and the balance essentially iron and incidental impurities. The ferritic stainless steels of the present invention are particularly useful in welded structures because the weld metal displays superior impact properties.

24 Claims, No Drawings

FERRITIC STAINLESS STEEL

FIELD OF THE INVENTION

The present invention relates to stainless steels, and more particularly to ferritic stainless steels.

BACKGROUND OF THE INVENTION

Semchyshen et al in a paper entitled "Effects of Composition on Ductility and Toughness of Ferritic Stainless Steels" and delivered in Japan in October 1971 succinctly reviewed the status of ferritic stainless steels as follows:

"Ferritic stainless steels have long been of interest to the designer and the metallurgist because of potentially lower costs compared with austenitic grades and because of their resistance to stress-corrosion cracking in the presence of chloride ions. The factors that have prevented the wide-spread utilization of conventionally-melted ferritic grades have been limited room-temperature toughness together with embrittlement and increased sensitivity to intergranular corrosion after welding or heating at high temperatures.

"As long ago as 1951, Binder and Spendelow(1) and Hochmann(2) demonstrated that the toughness of straight chromium ferritic steels was sensitive to the combined carbon and nitrogen content. Binder and Spendelow showed, for example, that the limiting carbon plus nitrogen content consistent with good toughness in a nominally 18% Cr steel was about 0.05%. A comparable value for a 25% Cr steel was closer to 0.03%.

"More recently, Wright(3) confirmed a maximum carbon plus nitrogen level of 0.03% for a steel containing 26% Cr, 1% Mo and 0.22% Ti to give acceptable toughness in 3 mm-thick sheet. Somewhat higher tolerances for interstitial elements were reported for thinner sheet.

"Binder and Spendelow(4) achieved low interstitial contents in vacuum-melted laboratory-scale heats by using extremely high-purity charge materials. Such a practice was, of course, not put into commercial production because its implementation would negate the economic advantages of the ferritic grades. Thus the concept of low-interstitial ferritic grades was not exploited until recent years when new steel-making techniques such as oxygen-argon melting, vacuum refining and electron-beam refining progressed to the point of economic feasibility."

Ferritic stainless steels containing between about 12% and about 30% chromium, up to about 5% molybdenum, up to about 5% nickel and the balance essentially iron are well known in the art. Variations of this class of alloys have been developed to overcome certain disadvantages. See U.S. Pat. Nos. 3,807,991; 3,890,143; 3,929,473; 3,932,174; 3,932,175 and 3,957,544.

Although the addition of stabilizers has improved both the impact and the corrosion properties, ferritic stainless steels would find even greater use if their impact properties could be further improved. For example, ferritic steels having even better impact properties could be used in marine hardware that is utilized in colder climates, chemical processing equipment, food and beverage processing equipment, desalinization equipment, fasteners and heat exchangers and condensers.

BRIEF DESCRIPTION OF THE INVENTION

Generally speaking, the present invention is directed to a ferritic stainless steel which is characterized by improved impact properties. The ferritic stainless steel consists essentially of between about 21% and about 30% chromium, up to about 5% molybdenum, up to about 6% nickel, between about 0.1% and about 0.4% niobium, between about 0.1% and about 0.75% aluminum, up to about 0.3% titanium, up to about 0.025% carbon, up to about 0.035% nitrogen, and the balance essentially iron and incidental impurities.

DETAILED DESCRIPTION OF THE INVENTION

Ferritic stainless steels in accordance with the present invention have the following composition expressed in weight percent:

Chromium —21% to 30%
Molybdenum —up to 5%
Nickel —up to 6%
Niobium —0.1% to 0.4%
Aluminum —0.1% to 0.75%
Titanium —up to 0.3%
Carbon —up to 0.025%
Nitrogen —up to 0.035%
Iron —Balance The ferritic steel in accordance with the present invention relates to ferritic stainless steels containing chromium in the range between about 21% and about 30%, and advantageously within the range of between about 24% and about 28%. Within these chromium ranges ferritic stainless steels exhibit excellent corrosion resistance, lower chromium contents do not provide the required corrosion resistance while ferritic stainless steels containing substantially greater amounts of chromium exhibit less acceptable impact properties. Chromium contents within the foregoing ranges when combined with the other alloying constitutents in accordance with the present invention provide excellent corrosion resistance and improved impact properties.

The ferritic stainless steel of the present invention contains up to about 5% molybdenum and advantageously, between about 2% and about 5%. As the molybdenum content falls below about 2% there is a noticeable decrease of the corrosion resistance of the alloy, particularly in reducing environments. Molybdenum contents significantly higher than the foregoing ranges can cause a deterioration in the impact properties of the steel.

The ferritic stainless steels in accordance with the present invention can contain up to about 6% nickel and advantageously between about 2% and about 4.5%. Nickel contents within the foregoing ranges significantly improve the impact properties.

Control of the carbon and nitrogen contents is required to prevent intergranular corrosion and to improve impact properties. Excessive amounts of carbon and nitrogen lower the corrosion resistance of the alloy by forming carbides, nitrides, or complex carbonitrides, which deplete the matrix of chromium. The ferritic stainless steels of the present invention can contain up to about 0.025% carbon, advantageously between about 0.01% and about 0.02% carbon, e.g. about 0.015%. Nitrogen can be present in amounts up to 0.035% and advantageously between about 0.01% and about 0.03%.

An important aspect of the present invention is the use of a special combination of stabilizers to minimize the adverse effects of carbon and nitrogen on the impact and corrosion properties of ferritic stainless steels. It has been found that when aluminum is combined with well known stabilizers, such as niobium and titanium, the impact properties of the base metal and weld metal can be improved significantly.

Niobium is the preferred stabilizer and is present in amounts between about 0.1% and about 0.4%, advantageously in amounts between about 0.1% and about 0.3%. Lower amounts of niobium provide incomplete stabilization while niobium contents exceeding 0.4% have adverse effects on the impact properties. Advantageously, niobium is added in amounts to provide a niobium to carbon weight ratio between about 7:1 and about 10:1 and most advantageously about 8:1.

Titanium may also be employed as a stabilizer in amounts up to about 0.3%, advantageously in amounts up to 0.1%. Although titanium is effective as a stabilizer, the blocky form of titanium carbides and nitrides can have deleterious effects on the mechanical properties of the steel. In a preferred embodiment of the present invention, no intentional titanium additions are made.

The use of aluminum as a nitrogen stabilizer is an important feature of the present invention. Aluminum is present in amounts between about 0.1% and about 0.75%, advantageously in amounts between about 0.2% and about 0.5%. Aluminum contents within the foregoing ranges significantly improve the impact properties without any adverse effects on the corrosion resistance. The improvement in impact properties is particularly noticeable in the weld metal. Niobium and aluminum stabilized steels in accordance with the present invention have subzero transition temperatures after welding.

After melting by means conventional to the stainless steel art, the melt can be cast into ingots and then broken down by forging at temperatures between about 1090° C. and about 1200° C. with lower forging temperatures being used for titanium stabilized steels. Alternatively, the melt can be continuously cast as slab. Further reduction in size can be accomplished by hot rolling between about 1200° C. and about 1000° C., e.g. 1090° C. Final size reduction is accomplished by cold rolling between about 315° C. and about 25° C., e.g. about 100° C. The final product can then be annealed at between about 1090° C. and about 1080° C. and rapidly cooled from the annealing temperature to minimize or avoid the formation of second phases. Water quenching is usually sufficiently rapid to minimize the formation of second phases. The annealed and rapidly cooled steel generally has a grain size between about 25 microns and about 40 microns and is fully ferritic.

Niobium-aluminum stabilized ferritic stainless steels of the present invention have superior impact properties. Impact properties are commonly determined by the Charpy V-Notch Impact. Charpy impact tests are conducted on a test specimen having a notch machined to carefully defined specifications. The notched specimen is supported on both ends in the test machine and is broken by a swinging weighted pendulum. The energy absorbed in deforming and breaking the pendulum is determined by the height to which the pendulum swings after breaking the specimen. The Charpy impact test can be conducted at subatmospheric and superatmospheric temperatures to ascertain transition temperatures at which the fracture goes from shear fracture to cleavage fracture. The transition from shear to cleavage fracture (FATT) is not abrupt and the transition temperature is selected as that temperature at which the fracture surface exhibits 50% shear and 50% cleavage fracture on a macroscale. Another useful measurement is the upper shelf energy which is the average energy absorbed for samples which failed completely in the ductile mode, i.e., 100% shear.

Ferritic stainless steels in accordance with the present invention have transition temperatures (FATT) far lower than ferritic stainless steels that are not stabilized with aluminum. For example, a steel containing 2% nickel had a transition temperature of minus 52° C. while a steel containing about 4% nickel had a transition temperature of minus 106° C. Only ferritic stainless steel containing more nickel had lower transition temperatures. Even more remarkable is that autogenously generated weld metal from the steels of the present invention had transition temperatures approaching that of the base metal.

An advantageous embodiment of the present invention is the use of niobium-aluminum stabilized ferritic stainless steel in welded structures. Examples of uses of welded structures include heat exchangers and condenser tubes which are manufactured by welding sheets of the ferritic stainless steels of the present invention. The welded structure can be produced by autogeneous welding using conventional shielded arc welding techniques. Ferritic stainless steels of the present invention can also be welded using highly alloyed austenitic filler metals, e.g. Inconel 625, under gas, preferably shielded arc.

The following illustrative example is given to provide the skilled artisan with a better understanding of the ferritic stainless steels in accordance with the present invention:

EXAMPLE I

Three 29.5 kilogram heats of ferritic stainless steels were produced by melting in a vacuum induction furnace under 0.5 atmosphere of argon. Each heat was treated with a specific stabilizer system. The nickel content was varied by dividing each heat into two or three splits. For two heats 2% and 4% nickel was the desired content. For the third heat a three way split yielding 2%, 3% and 4% nickel was desired. One ingot was cast for each of the seven tests. The chemical analysis of each composition is shown in Table I.

The ingots were forged at 1200° C. for steels 1781A, 1781B, 1783A, 1783B and 1783C and steels 1782A and 1782B were forged at 1090° C. The ingots were reduced to 25 millimeters by forging. One-half of each composition was then hot rolled at 1090° C. to 22 millimeters and the other half of each composition was hot rolled to 11 millimeters. The plates were then grit blasted clean and cool rolled at 260° C. to 3.2 millimeters and 1.15 millimeters, half of the material to each thickness. The sheets were then annealed for 5 minutes at 1065° C. and water quenched. The annealed sheets were cut into coupons for welding.

Full penetration autogeneous automatic gas tungsten-arc (GTA) welds were made. Argon gas was used for primary, backing and trailing shielding. Welding was conducted in such a manner as to provide full penetration welds with a profile that permitted extracting quarter sized Charpy V-notch specimens.

The intergranular corrosion resistance of the weldments was evaluated using a modified Strauss test. This test consists of immersing the welded specimens for 120 hours in 5 milliliters of boiling 50% sulfuric acid plus 6% copper sulfide solution and 25 grams of copper chips. The weldment specimens were cut into strips 12 millimeters by 50 millimeters with the weld in the middle transverse to the long axis. The sample is kept out of contact with the copper chips by suspending the sample in the liquid. After exposure the specimens are bent over a radius equal to twice the thickness of the sample (2T) through 180° or until failure of the weld at the apex of the bend. The samples were then examined using a microscope for indications of corrosion. The specimens passed the modified Strauss test with no grain dropping or fissuring after bending across a 2T radius.

Charpy V-notch test specimens were then prepared for both the base metal and welded specimens and Charpy V-notch tests were conducted on these specimens. The results of these Charpy V-notch tests are reported in Table II. The transition temperature was generally lower for the base metal then for the weld metal, the one exception being the 2% nickel niobium aluminum-stabilized steel. The transition temperature (FATT) was lower for steels with higher nickel contents. The lowest base metal transition temperatures were minus 90° C. for the titanium stabilized steel, minus 105° C. for the niobium aluminum-stabilized steel and minus 134° C. for the titanium-niobium-aluminum stabilized steel with the first two steels containing about 4% nickel and the third containing about 4½% nickel. The transition temperature range of weld metals was different than for the base metals although the approximately 4% nickel steels had lower transition temperature than 2% nickel steels. Reference to Table II confirms that niobium-aluminum stabilized steels of the present invention have significantly lower transition temperatures than steels stabilized in accordance with conventional stabilizing practice. Moreover, the results of Table II confirm that niobium-aluminum stabilized ferritic stainless steel welds have significantly lower transition temperatures than conventional ferritic stainless steel welds.

The upper shelf energy absorption for the niobium-aluminum alloy welds was twice the level for the base metal. Increased nickel contents acted to reduce the impact energy absorbed. Increasing the nickel content also acted to reduce the tendency for a sharp transition between ductile and brittle behavior in the impact tests. This was most noticeable for the titanium-niobium stabilized steels and least noticeable in the niobium-aluminum stabilized steels.

TABLE II

Charpy V-Notch Results (Quarter Sized Specimens)

| Alloy | 50% Shear FATT | | | | Upper Shelf Energy | | | |
|---|---|---|---|---|---|---|---|---|
| | Base | | Weld | | Base | | Weld | |
| | Temperature | | | | | | | |
| No. | °C. | °F. | °C. | °F. | J | Ft-Lb | J | Ft-Lb |
| 1781A | −52 | −62 | −58 | −72 | 19 | 14 | 35 | 26 |
| 1781B | −106 | −160 | −79 | −110 | 18 | 13 | 34 | 25 |
| 1782A | −18 | 0 | 54 | 130 | 23 | 17 | 23 | 17 |
| 1782B | −90 | −130 | 23 | 74 | 22 | 16 | 18 | 13 |
| 1783A | −23 | −10 | 52 | 125 | 23 | 17 | 27 | 20 |
| 1783B | −46 | −50 | 24 | 75 | 22 | 16 | 23 | 17 |
| 1783C | −134 | −210 | −54 | −65 | 22 | 16 | 20 | 15 |

Although the present invention has been described in conjunction with advantageous embodiments, it is to be understood that modifications and variations may be resorted to without departing from the spirit and scope of the invention as those skilled in the art will readily understand. Such modifications and variations are considered to be within the purview and scope of the invention and appended claims.

We claim:

1. A ferritic stainless steel, characterized by improved impact properties, which consists essentially of between about 21% and about 30% chromium, up to about 5% molybdenum, between about 2% and 4.5% nickel, between about 0.1% and about 0.4% niobium, between about 0.2% and about 0.75% aluminum, up to about 0.025% carbon, up to about 0.035% nitrogen and the balance essentially iron and incidental impurities with a niobium to carbon weight ratio of less than about 10:1.

2. The ferritic stainless steel as described in claim 1 wherein the chromium content is between about 24% and about 28%.

3. The ferritic stainless steel as described in claim 2 wherein the molybdenum content is between about 2% and about 5%.

4. The ferritic stainless steel described in claim 3 wherein the aluminum content is between about 0.2% and 0.5%.

5. The ferritic stainless steel as described in claim 4 wherein the carbon content is between about 0.01% and about 0.02%.

6. The ferritic stainless steel as described in claim 5 wherein the nitrogen content is between about 0.01% and about 0.03%.

7. The ferritic stainless steel as described in claim 6 wherein the niobium content is between about 0.1% and about 0.3%.

8. The ferritic stainless steel as described in claim 7 wherein the aluminum content is between about 0.2% and about 0.5%.

9. The ferritic stainless steel as described in claim 8 wherein the niobium content is such as to provide a

TABLE I

| Alloy | Alloying Constituents, Wt. % | | | | | | | | | | | |
|---|---|---|---|---|---|---|---|---|---|---|---|---|
| No. | Cr | Mo | Ni | C | N | Mn | Si | S | P | Nb | Al | Ti |
| 1781A | 25.32 | 3.56 | 2.02 | 0.015 | 0.014 | 0.30 | 0.26 | 0.010 | 0.021 | 0.18 | 0.36 | — |
| 1781B | 24.53 | 3.54 | 3.90 | 0.014 | 0.013 | 0.29 | 0.27 | 0.011 | 0.019 | 0.17 | 0.32 | — |
| 1782A | 25.51 | 3.54 | 2.08 | 0.015 | 0.017 | 0.30 | 0.29 | 0.010 | 0.020 | — | 0.03 | 0.31 |
| 1782B | 24.58 | 3.49 | 3.98 | 0.015 | 0.016 | 0.30 | 0.27 | 0.010 | 0.020 | — | 0.03 | 0.27 |
| 1783A | 25.12 | 3.54 | 2.06 | 0.014 | 0.015 | 0.30 | 0.28 | 0.009 | 0.016 | 0.32 | 0.013 | 0.11 |
| 1783B | 24.92 | 3.50 | 3.02 | 0.013 | 0.015 | 0.30 | 0.26 | 0.009 | 0.014 | 0.32 | 0.012 | 0.10 |
| 1783C | 24.41 | 3.50 | 4.66 | 0.013 | 0.015 | 0.29 | 0.27 | 0.009 | 0.012 | 0.32 | 0.012 | 0.08 |

niobium to carbon weight ratio of between about 7:1 and about 10:1.

10. The ferritic stainless steel as described in claim 9 wherein the niobium to carbon weight ratio is about 8:1.

11. A ferritic stainless steel, characterized by improved impact properties, which consists essentially of between about 24% and about 28% chromium, between about 2% and about 5% molybdenum, between about 2% and about 4.5% nickel, up to about 0.025% carbon, up to about 0.035% nitrogen, between about 0.1% and about 0.3% niobium, between about 0.2% and about 0.5% aluminum, and the balance essentially iron and incidental impurities with a niobium to carbon weight ratio of less than about 10:1.

12. The ferritic stainless steel as described in claim 11 wherein the carbon content is between about 0.01% and about 0.02%.

13. The ferritic stainless steel as described in claim 12 wherein niobium is present in an amount such that the niobium to carbon weight ratio is between about 7:1 and about 10:1.

14. The ferritic stainless steel as described in claim 13 wherein the niobium to carbon weight ratio is about 8:1.

15. The ferritic stainless steel as described in claim 13 wherein the nitrogen content is between about 0.01% and about 0.03%.

16. An article comprising at least one standard sheet of ferritic stainless steel, characterized by improved impact properties, which consists essentially of between about 21% and 30% chromium, up to about 5% molybdenum, between about 2% and about 4.5% nickel, between about 0.1 and about 0.4% niobium, between about 0.2% and about 0.75% aluminum up to about 0.025% carbon, up to about 0.035% nitrogen and the balance essentially iron and incidental impurities with a niobium to carbon weight ratio of less than about 10:1.

17. The article as described in claim 16 wherein the chromium content is between about 24% and about 28%.

18. The article as described in claim 17 wherein the molybdenum content is between about 2% and about 5%.

19. The article as described in claim 19 wherein the carbon content is between about 0.01% and about 0.02%.

20. The article as described in claim 19 wherein the nitrogen content is between about 0.01% and about 0.03%.

21. The article as described in claim 20 wherein the niobium content is between about 0.1% and about 0.3%.

22. The article as described in claim 21 wherein the aluminum content is between about 0.2% and about 0.5%.

23. The article as described in claim 22 wherein the niobium content is such as to provide a niobium to carbon weight ratio of between about 7:1 and about 10:1.

24. The article as described in claim 23 wherein the niobium to carbon weight ratio is about 8:1.

* * * * *